US006095827A

United States Patent [19]

Dutkowsky et al.

[11] Patent Number: 6,095,827

[45] **Date of Patent: *Aug. 1, 2000**

[54] ELECTRICAL CONNECTOR WITH STRESS ISOLATING SOLDER TAIL

[75] Inventors: David J. Dutkowsky, Tokyo, Japan; Mark S. Schell, Palatine, Ill.

[73] Assignee: Berg Technology, Inc., Reno, Nev.

[ * ] Notice: This patent is subject to a terminal disclaimer.

[21] Appl. No.: 09/051,840

[22] PCT Filed: Oct. 24, 1996

[86] PCT No.: PCT/US96/17078

§ 371 Date: Aug. 4, 1998

§ 102(e) Date: Aug. 4, 1998

[87] PCT Pub. No.: WO97/15966

PCT Pub. Date: May 1, 1997

[51] Int. Cl.[7] ..... H01R 12/00

[52] U.S. Cl. ..... 439/83; 439/326

[58] Field of Search ..... 439/83, 326, 327, 439/61, 541.5, 62, 79, 80

[56] References Cited

U.S. PATENT DOCUMENTS

| | | | |
|---|---|---|---|
| 4,470,648 | 9/1984 | Davis et al. | 339/14 R |
| 4,702,708 | 10/1987 | Reuss et al. | 439/83 |
| 4,722,691 | 2/1988 | Gladd et al. | 439/79 |
| 4,756,694 | 7/1988 | Billman et al. | 439/61 |
| 4,802,860 | 2/1989 | Kikuta | 439/79 |
| 4,955,820 | 9/1990 | Yamada et al. | 439/83 |
| 4,992,056 | 2/1991 | Douty et al. | 439/83 |
| 5,085,601 | 2/1992 | Buchter et al. | 439/660 |
| 5,122,066 | 6/1992 | Plossmer | 439/78 |
| 5,167,531 | 12/1992 | Broschard et al. | 439/540 |
| 5,176,523 | 1/1993 | Lai | 439/64 |
| 5,201,663 | 4/1993 | Kikuchi et al. | 439/83 |
| 5,387,112 | 2/1995 | Chishima | 439/67 |
| 5,393,234 | 2/1995 | Yamada et al. | 439/62 |
| 5,547,384 | 8/1996 | Benjamin | 439/83 |
| 5,562,461 | 10/1996 | Obara et al. | 439/326 |
| 5,697,802 | 12/1997 | Kawabe | 439/326 |
| 5,915,979 | 6/1999 | Schell et al. | 439/326 |

FOREIGN PATENT DOCUMENTS 0 385 577 9/1990 European Pat. Off. .

*Primary Examiner*—Paula Bradley
*Assistant Examiner*—Tho D. Ta
*Attorney, Agent, or Firm*—Brian J. Hamilla; M. Richard Page

[57] ABSTRACT

An upper and lower contact especially for a double-deck or dual in-line module, each includes a solder tail that is coupled to the main body of the contact by a compliant portion. The compliant portion is thus intermediate the main body and the solder portion of the solder tail. The compliant portion isolates and absorbs stresses induced on the module housing through card insertion such that the solder joint does not receive the stress. Additionally, the provision of a compliant portion absorbs non-linearities created by circuit board warpage on which the module is attached. The compliant portion may take the form of a modified spring, a U-shaped section, a radiused section, or other form.

27 Claims, 10 Drawing Sheets

ELECTRICAL CONNECTOR WITH STRESS ISOLATING SOLDER TAIL

CROSS-REFERENCE TO RELATED APPLICATIONS

This Application is a national stage entry of International Application PCT/US96/17078 filed on Oct. 24, 1996, which claims the benefit of U.S. patent application Ser. No. 08/535,452 filed on Oct. 24, 1995, now abandoned.

This Application is also related to U.S. patent application Ser. No. 08/910,787, filed on Aug. 13, 1997, now U.S. Pat. No. 5,915,979, which is a continuation of application Ser. No. 08/535,452.

FIELD OF THE INVENTION

The present invention relates to electrical connectors and their associated terminals or contacts that are adapted to be mounted to a printed circuit board and, more particularly, to an improved electrical contact for an electrical connector.

BACKGROUND OF THE INVENTION

In electronic components of today, especially computers, various devices, add-ons, and peripherals are attached or interfaced with the computer or otherwise via electrical connectors. These connectors are usually mounted in some manner to printed circuit boards (PCB's) such that the attached device is electrically coupled thereto. In general, connectors are either surface mounted or through mounted to the circuit board. Additionally, some connectors accept printed circuit boards from the top (vertical insertion) while other connectors accept printed circuit boards from the side (horizontal insertion).

All of the connectors have a plurality of electrical terminals or contacts that are adapted to contact leads of the PCB of the attached device or a card containing components, and also to attach to the main PCB on which the connector is mounted.

The portion of the contacts that are attached to the circuit board are generally known as the solder tails. The solder tails are electrically coupled to the various circuits of the circuit board by soldering the ends of the solder tails to soldering pads located on the PCB. However, the point of soldering or connection is naturally a weak spot. During insertion of a card or circuit board into the connector, the insertion forces on the housing of the connector translate into forces or stress on the solder tail that strains the point of connection or soldering of the solder tail to the circuit board. Such stress can cause the solder tails to become detached from the PCB with the result that there is a break in the electrical connection between the connector and the PCB. This is especially true where the card or circuit board is horizontally received in the connector. In this case, the forces on the solder points (the soldered connection of the solder points of the solder tails and the solder pads of the PCB) are tangential resulting in a shearing effect. The repeated shearing stress weakens or ruptures the connection. Even connectors that receive cards or PCB's vertically experience forces during insertion and removal of the cards or PCB's such as to create shearing forces at the solder points. Additionally, PCB warpage or other stresses can be detrimental to the solder joints.

With the above in mind, it is an object of the present invention to provide an electrical connector adapted to receive a card or device PCB and mountable to a main printed circuit board, that includes contacts or terminals which absorb stress as a result of insertion or removal of a printed circuit board.

It is further an object of the present invention to provide a blanked or stamped contact for an electrical connector that is sturdy yet compliant for absorbing or isolating stress.

It is yet another object of the present invention to provide a double-deck in-line module (DDIM) or dual in-line module (DIM) for horizontal receipt of memory cards wherein the solder tails absorb or isolate stresses on the soldering joints as a result of card insertion and/or removal.

SUMMARY OF THE INVENTION

A socket for PCB's in accordance with the present invention comprises a housing made of an insulating material and having a plurality of insertion holes opened on one side in a juxtaposed relation to allow edges of the printed boards to be received therein. A larger number of spring contacts made of an electroconductive material and formed in at least one contact array in, and along a longitudinal direction of, the respective insertion hole with their contact portions projected in the insertion hole and adapted to urge the respective printed boards in the same direction with the edges of the PCB's inserted into the insertion holes relative to the respective contact arrays are also included. The socket also has a plurality of pairs of latch arms extending from near-end areas of the respective insertion holes and, when the respective PCB's are rotated in a direction to urge the contacts, latching the side edges of the printed board. The PCB's are thereby fitted in the respective insertion holes are held by the paired latch arms in a juxtaposed state.

The invention also encompasses an electrical connector, such as a dual in-line module (DIM) or double-deck in-line module (DDIM) having contacts each of which includes a compliant section integrally formed in the solder tail. The compliant section is disposed between the main body of the contact and the attachment or soldering joint where the contact connects with the PCB. In accordance with the present invention, the compliant section is a bend or spring-like portion that allows the housing of the module or connector to twist or bend without significantly disrupting the solder bond between the soldering joint of the solder tail and the solder pads of the printed circuit board. The compliant sections of the contacts act like shock absorbers to isolate the stresses from the soldering point by moving the stress out and away from the solder joints. The contacts are blanked or stamped rather than formed in order to increase the co-planarity between the solder tails and the soldering points. A suitable electrically conducting metal is utilized for the contact stock.

Because of the compliant section and its compliance action, the solder attachment point is isolated from the stresses induced in the housing and transmitted along the solder tail of the contact towards the soldering point. The compliant section absorbs the movement caused by card insertion into and removal from the connector.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DESCRIPTION OF THE PREFERRED EMBODIMENTS

Figure 1:
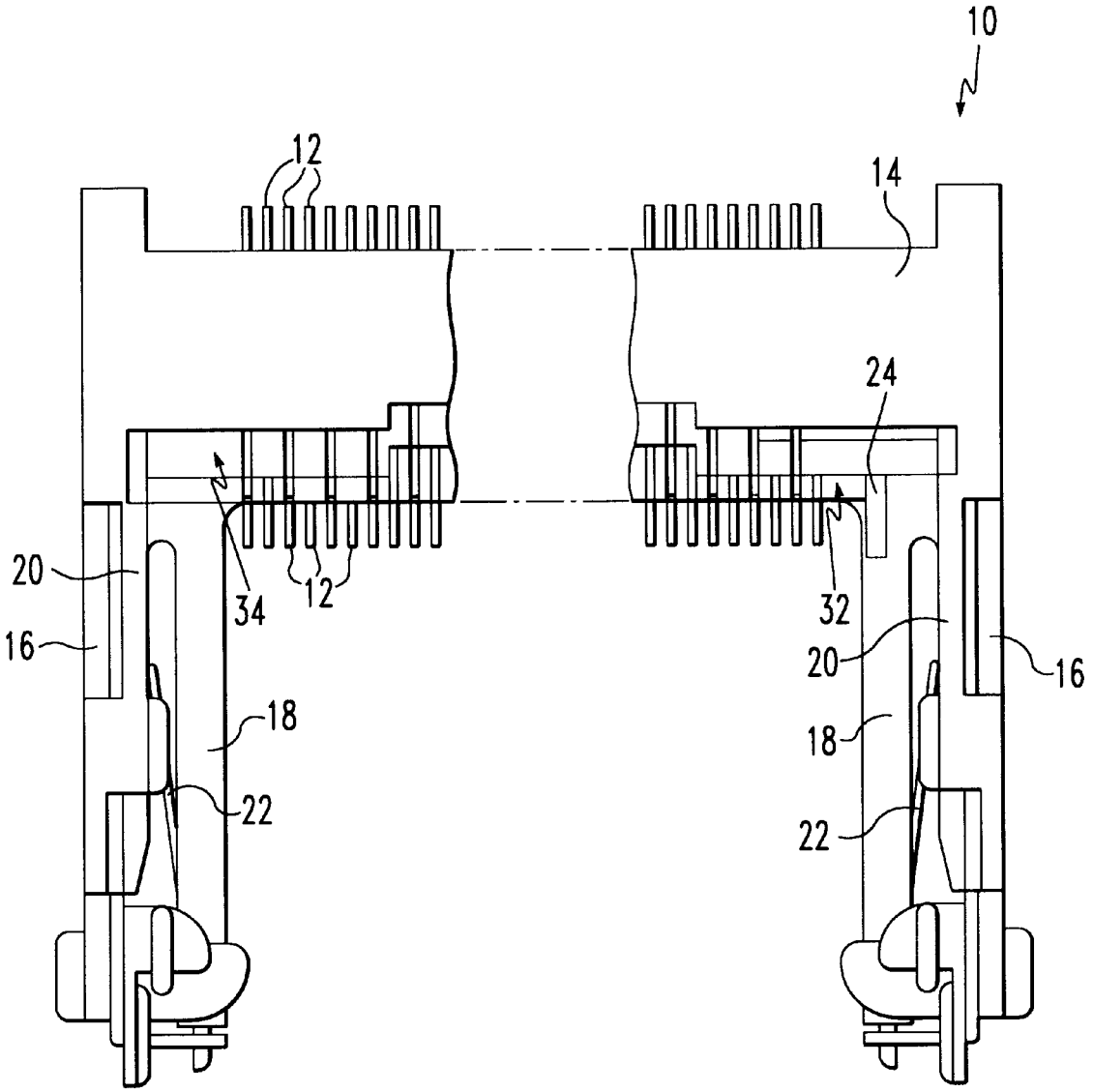
FIG. 1 is a plan view diagrammatically showing a first preferred embodiment of a socket for PCB's in accordance with an embodiment of the present invention.

FIGS. 1 to 7 show a socket 10, for PCB's according to the present invention. As shown in FIG. 1, the socket 10 for PCB's includes a housing 14 with a large number of spring contacts 12 arranged at predetermined intervals. A pair of support arms 16, 16, as well as latch arms 18, 18 and 20, 20 constituting two pairs of latch arms, extend one at each end of the housing 14. Latches 22, 22 as will be set out above are attached to the support arms 16, 16, The latch arms 18, 18 and latch arms 20, 20 are guided by the latch guides 22, 22. The housing 14, support arms 16, 16, and latch arms 18, 18, 20, 20 are formed as an integral member and made of an insulating material, such as an LCP (liquid crystal polymer). Reference numeral 24 shows a polarity key which prevents the insertion error of printed boards 6, 8 (see FIGS. 3 and 5).

Figure 2:
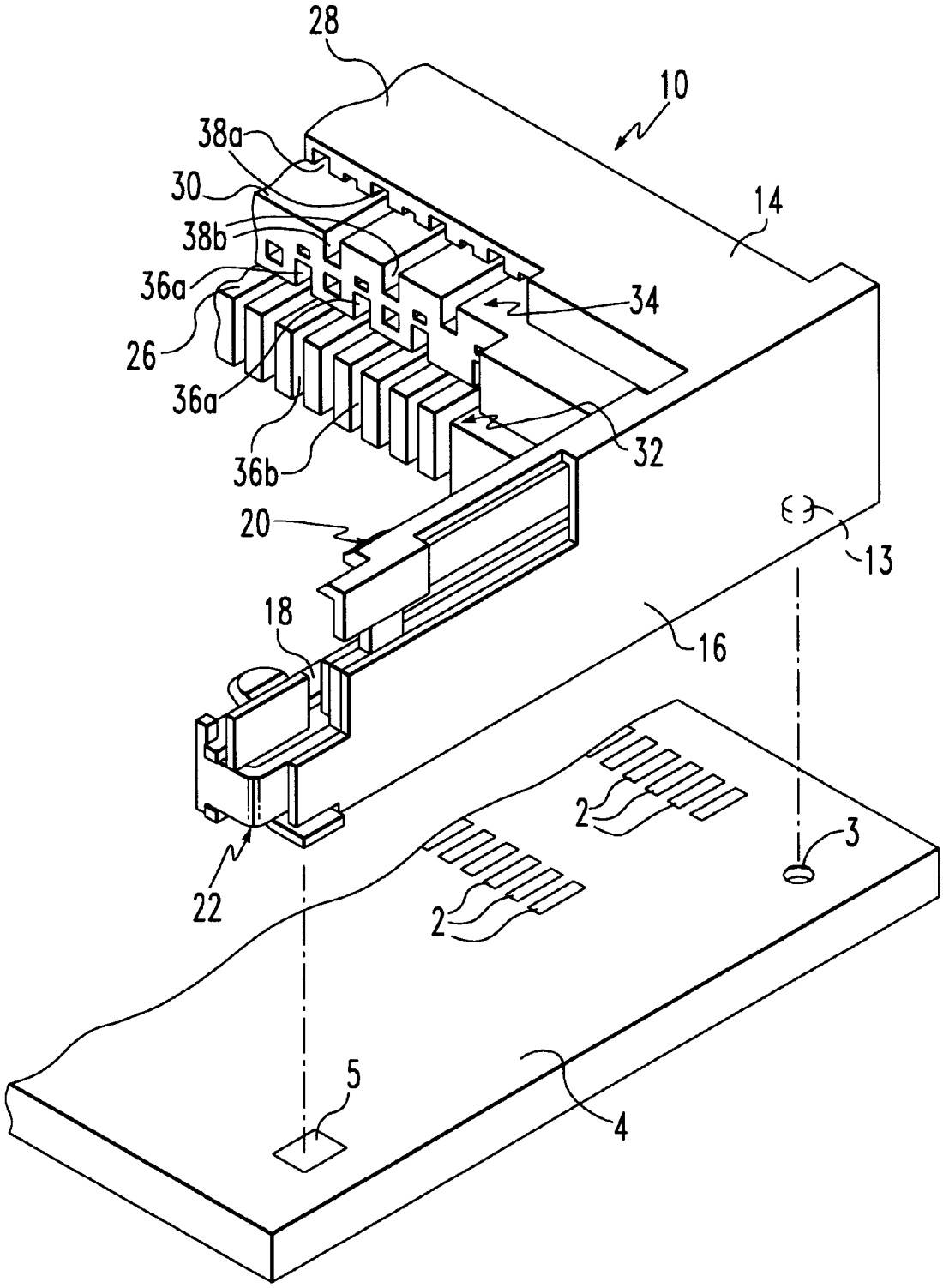
FIG. 2 is a perspective view diagrammatically showing a portion of a housing structure with spring contacts omitted.

As shown in FIG. 2, the housing 14 has lower and upper wall sections 26 and 28 providing a pair of outer wall sections on the upper and lower sides and an intermediate wall section 30 situated between the lower wall section 26 and the upper wall section 28. The intermediate wall section 30 extends further from the upper wall section 28 and the lower wall section 26 extends still further from the intermediate wall section 30. Insertion slots 32 and 34 are provided one between the lower wall section 26 and the intermediate wall section 30 and one between the intermediate wall section 30 and the upper wall section 28 side to receive the edges of printed boards 6, 8 (FIGS. 4 and 5) comprising a daughter board each. The insertion slots 32, 34 extend across both the end portions of the housing 14 and are situated substantially parallel to each other. The spacing between the insertion slots 32, 34 is made somewhat greater than the thickness of the PCB's 6, 8 and formed such that, upon being inserted, these boards are placed in a not mutually contacting state.

The paired latch arms 18, 18 are coupled to the lower wall section 26 at those areas near the longitudinal ends of the insertion slot 32 situated at the lower side and their upper surfaces situated on the insertion slot 32 side are placed in substantially the same plane as the upper surface of the lower wall section 26. Further, the latch arms 20, 20 are coupled to the upper wall section 28 at those areas near the longitudinal ends of the insertion slot 34 situated on the upper side. These latch arms 18, 20 are made smaller in cross-section than the support arms 16 to provide a flexible structure. On the other hand, the support arm 16 has a relatively rigid structure.

As shown in FIG. 2 the socket 10 for PCB's, according to the present invention is of such a so-called side entry type that the board is inserted in parallel to the surface of a mother board 4 of an electronic apparatus, that is, inserted with the insertion slots 32, 34 opened in a lateral direction. In this case, an alignment projection 13 is provided on the housing 14 and fitted in an alignment hole 3 in the mother board 4 so that the support arms 16, 16 are horizontally placed on the surface of the mother board. From the type of a contact array, the socket is made a so-called DIMM (dual in-line memory module) type.

Contact grooves 38A are opened at a predetermined equidistant interval at the insertion slot 34 side of the upper wall section to receive the corresponding spring contacts 12 in a mutually insulated state. Even in the intermediate wall section 30 extending further than the upper wall section 26, contact grooves 38*b* are opened at a predetermined equidistant interval on the insertion slot 34 side. These contact grooves 38*a*, 38*b* are alternately provided along the longitudinal direction of the insertion slot 34.

Similarly, even at the insertion slot 32 side of the intermediate wall section and lower wall section, contact grooves 36*a*, 36*b* are opened such that they are alternately arranged at a predetermined interval along the longitudinal direction of the insertion hole 32. The spring contacts 12 are fitted in the contact grooves 36*a*, 36*b* in a mutually insulated state.

Figure 3:
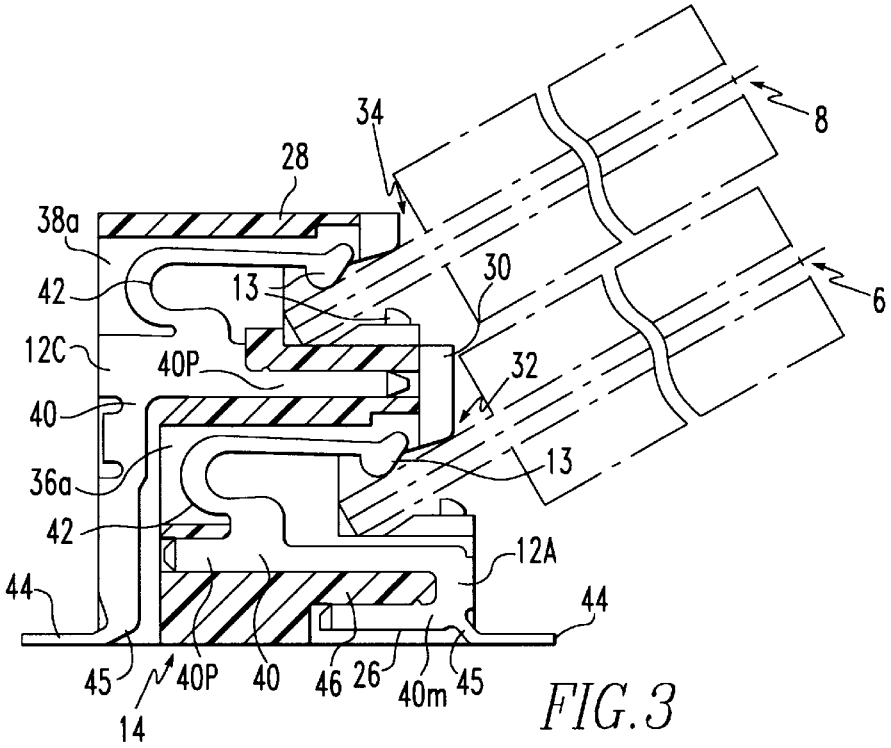
FIG. 3 is a cross-sectional view showing an arrangement of the spring contacts in the housing.
Figure 4:
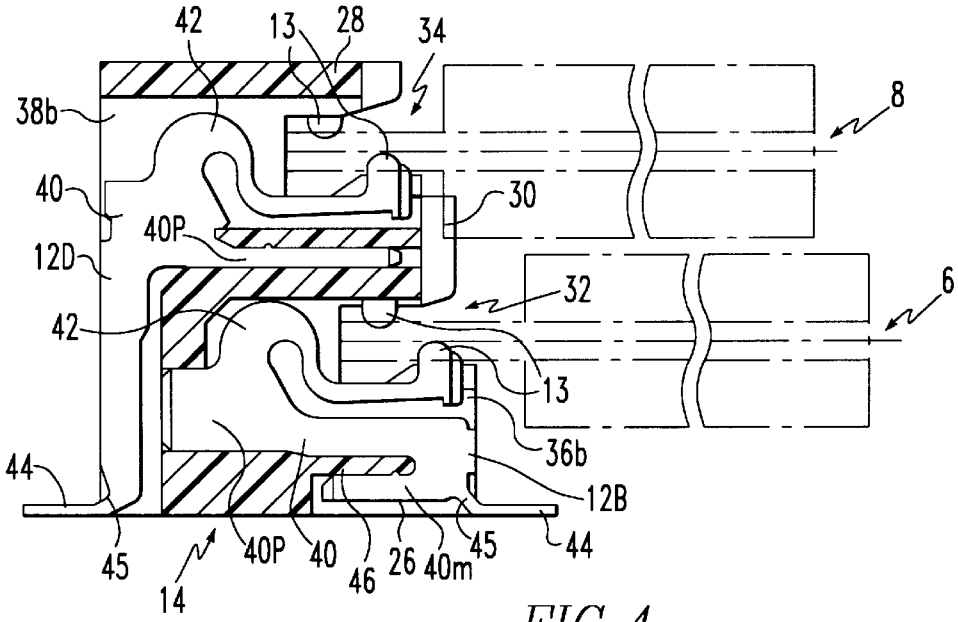
FIG. 4 is a cross-sectional view showing a state in which PCB's are mounted in the housing.

As shown in FIGS. 3 and 4, the spring contacts 12 of the present embodiment comprise four kinds of spring contacts 12A, 12B, 12C and 12D of different shapes punched out of an electroconductive material such as a copper alloy sheet material.

The spring contacts 12A, each, have a contact portion 13 extending from the contact groove 36*a* of the intermediate wall section 30 into the insertion slot 32 and all provide a contact array along the longitudinal direction of the insertion slot 32. The spring contacts 12B, each, have a contact portion 13 extending from the contact groove 36*b* of the lower wall section 26 into the insertion slot 32 and all provide a contact array along the longitudinal direction of the insertion slot 32. The spring contact 12C, each, have a contact portion 13 extending from the contact groove 38*a* of the upper wall section 28 into the insertion slot 34 and all provide a contact array along the longitudinal direction of the insertion slot 34. The spring contacts 12D, each, have a contact portion 13 extending from the contact groove 38B of the intermediate wall section 30 into the insertion hole 34 and all provide a contact array along the longitudinal direction.

The contact portions 13 of the respective spring contacts 12A and 12B provide an array of contacts arranged in the insertion slot 32 and situated in a depth direction in an offset relation so that they urge the printed board 6 in a counterclockwise direction through the edge of the printed board 6. Similarly, the contact portions 13 of the spring contacts 12C and 12D provide an array of contacts arranged in the insertion slot 34 and situated in a depth direction in an offset relation so that they urge the printed board 8 in a counterclockwise direction through the edge of the printed board 8. For this reason it is desirable that a holding section be provided on the intermediate wall section 30 and upper wall section 28 at least at those areas facing the insertion slots 32 and 34. Against urging forces of the respective spring contacts 12A, 12B, 12C and 12D, such holding sections can support the respective PCB's 6 and 8 in a state as shown in FIG. 3. Further, when the PCB's 6 and 8 are unlatched from the latch arms 18 and 20, the holding sections can prevent the printed boards 6 and 8 from being abruptely rotated and dropped by an impact force at that time from the insertion slots 32 and 34.

In the embodiment as shown in FIGS. 3 and 4, the spring contacts 12A, 12B, 12C and 12D, each, have a fixing section 40 fixed to the housing 14 and a spring section 42 extending from the fixing section 40 and elastically supporting the contact portion 13 of the spring contact. A post section 40P is provided on the fixing section 40 of the spring contact and closely fitted into a contact groove as will be set out below. It is to be noted that a projection may be provided on the fixing section 40 of the spring contact so that it can be bitten into the material of which the housing 14 is made. In this case it is possible to prevent dropping of the spring contact 12 from the housing.

Further, an electroconductive section 44 is provided as a projection on the fixing section 40 extending out of the housing 14. The electroconductive section 44 of the fixing section 40 is soldered to a corresponding electroconductive section 2 (FIG. 2) formed on the surface of the mother board 4. A flexible area 45 is provided at a leg section between the electroconductive section 44 and the fixing section 40 of the spring contact to allow a force involved to be absorbed. In the present embodiment, the flexible area 45 has a small inclined portion formed near the electroconductive section 44 so that it provides a deformable structure.

For this reason, even if the mother board 4, for example, is warped to produce any misalignment relative to the lower wall section 26 of the housing 14, the flexible area 45 can accommodate or alleviate such a misalignment and maintain a better contact state between the contact portion 13 and the printed board. Further, when the printed board is mounted on the housing, it is possible to prevent a force acting, by the spring section 42, upon the electroconductive section soldered to the electroconductive section 2 of the mother board 4.

On the other hand, the contact grooves 36*a*, 36*b*, 38*a* and 38*b* for accommodating the spring contacts 12A, 12B, 12C and 12D have spring section holding areas accommodating elastically deformable spring sections 42 and opened into, or communicating with, the corresponding insertion slots 32 and 34 and holding areas firmly holding the fixing sections 40 of the spring contacts in place and having inner holes closely receiving the post sections 40P in place. Further, the contact grooves 36*a*, 36*b*, 38*a* and 38*b* have connection areas to lead the electroconductive areas 44 to an outside of the housing and contact insertion hole opened outside the housing 14.

In the present embodiment, the contact insertion hole and connection area of the contact grooves 36A, 36B are opened on the right side of FIGS. 3 and 4 to allow the spring contacts 12A and 12B to be mounted from the insertion slot 32 side. On the other hand, the contact insertion hole and connection area of the contact grooves 38*a* and 38*b* are opened on the left side of FIGS. 3 and 4 and the spring contacts 12C and 12D can be mounted from a side opposite to the insertion hole 34.

Further, as will be appreciated from the above, in the case where the spring contacts 12 are mounted from both the sides of the housing 14, it can be done so for a very brief period of time even if a larger number of spring contacts 12 have to be mounted.

Further, a fixing wall 46 extends out in the holding area of the contact grooves 36A and 36B, The fixing wall 46 is held between the post section 40P formed on the spring contacts 12A and 12B and an arm section 40*m* extending in parallel to the post section 40P. Even in the case where the post section 40P or the inner hole closely holding the post section 40P in place is short in length, the respective contacts 12A and 12B can be positively held in the contact grooves 36A and 36B.

The contact portions 13 of the spring contacts 12A and 12B provide two contact rows in the insertion slot 32 along the longitudinal direction and these contact rows are arranged in an offset state along the insertion direction of the printed board 6. Similarly, the contact portions 13 of the spring contacts 12C and 12D provide two contact arrays in the insertion slot 34 along the longitudinal direction and these contact rows are arranged in an offset state along the insertion direction of the printed board 8. As shown in FIG. 3, the edge of the printed boards 6 and 8 are inserted into the insertion slots 32 and 34 and, when the printed boards 6 and 8 are rotated in a clockwise direction, the contact portions 13 are pushed by the edge of the printed boards and spring sections 42 of the spring contacts try to bring the contact portions back to an initial position. The respective contact portions 13 of the spring contacts are pressed by these spring forces into contact with the corresponding electroconductive sections to ensure positive contact therebetween. Further, by the contact rows arranged in such offset relation a counterclockwise moment acts upon the printed boards 6 and 8.

Figures 5A, 5B:
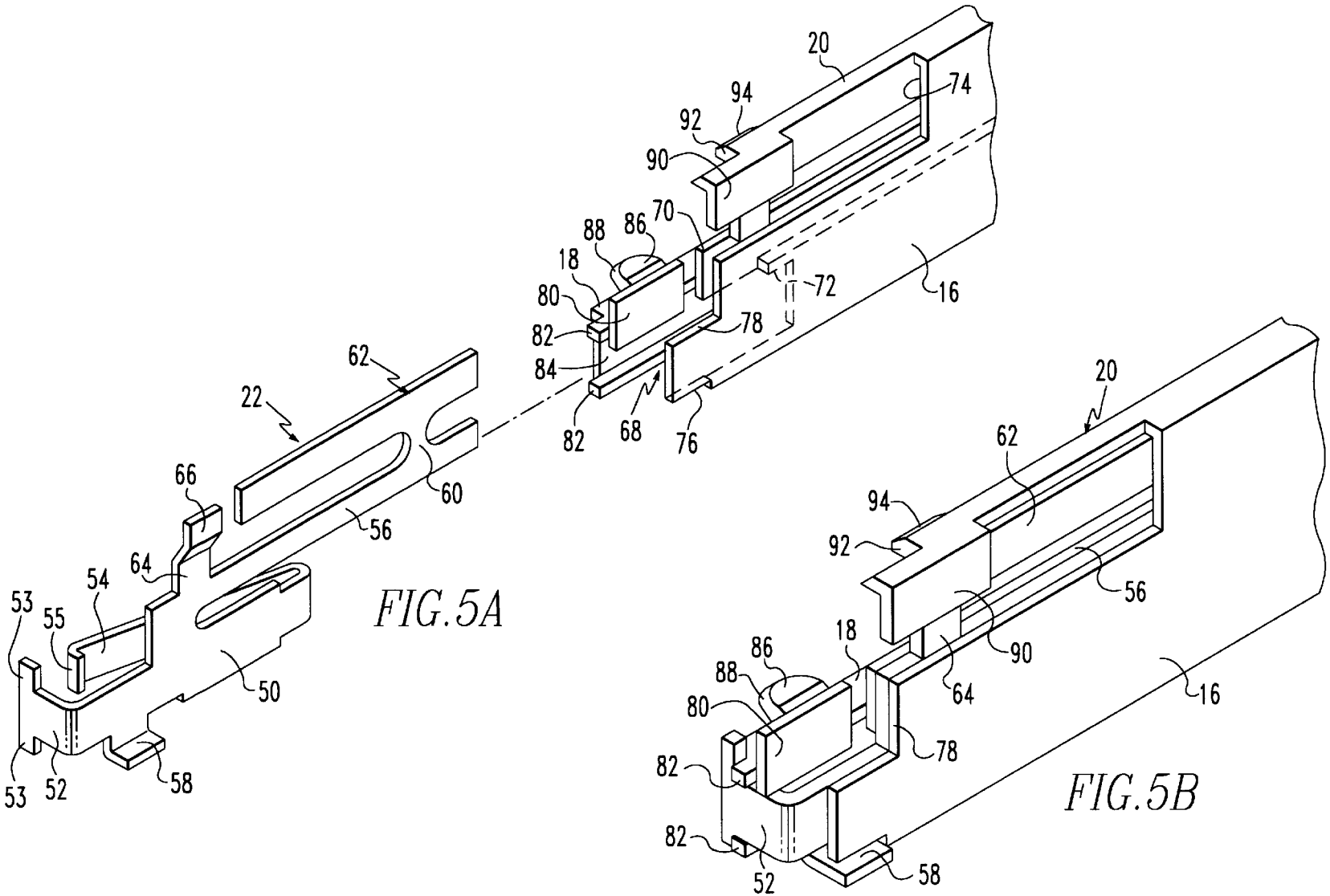
FIGS. 5A and 5B are perspective views, partly cut away, diagrammatically showing a structure of a latch mechanism.

FIG. 5 shows a latch mechanism for holding the printed circuit boards 6 and 8, which receive such a moment as set out above, at their side edges as viewed across their width direction. Such latch mechanisms for holding the side edges of the printed circuit boards are the same in their construction and only one of them will be explained below.

The latch mechanism of the present embodiment comprises a support arm 16 extending from the housing 14, a first latch arm 18, a second latch arm 20, and a latch guide 22 fitted relative to the support arm 16 to allow it to be guided by the latch arms 18 and 20. The support arm 16 and latch arms 18 and 20 are made of the same material as that of the housing 14.

As shown in FIG. 5, the latch guide 22 is formed of a sheet material, such as a copper alloy. The latch guide 22 of the present embodiment has a fitting section 50 fitted at the forward end of the support arm 16, a guide section 52 bent substantially perpendicular from one end of the fitting section 50 and a spring section 54 bent back in a substantially reverse direction from the other end of the fitting section 50. The fitting section 50 has an L-shaped latching section 56 extending from its upper edge and a fixing leg 58 extending from its lower edge and adapted to be joined, by soldering for example, to a fixing section 5 (FIG. 2) formed at the surface of the mother board 4. Further the guide section 52 has a rectangular sheet-like configuration with a guide edge provided at its upper and lower sides and has projections 53, 53 extending from its forward end side. The spring section 54 of the latch guide 22 is placed in a gap between the latch arm 18 and the support arm 16 and has a curved portion 55. When the latch arm 18 is retracted, the spring section 54 has its curved portion 55 abutted against it.

Further, the latch guide 22 has a sheet-like guide arm 62 coupled through a connection section 60 to the upper edge of the latching section 56 and an auxiliary arm 64 extending from the upper edge of the latching section 56. A forward end portion 66 of the auxiliary arm 64 extends on a side opposite to the spring section 54 and is formed to have a flat configuration substantially parallel to the guide arm 62.

As shown in FIG. 5, the support arm 16 has, at its forward end section, a receiving recess 68 provided on the latch arm 18 side to receive the fitting section 50 of the latch guide, a slit 70 provided adjacent and above the receiving recess 68 to receive the latching section 56 of the latch guide and an opening 74 through which the guide arm 62 is inserted. Between the receiving recess 56 and the slit 70 a projecting section 72 is projected toward the forward end of the support arm 16 and, when the latch guide is fitted into the support arm 16, the fixing section 72 is grasped between the fitting section 50 and the latching section 56. The guide arm 62 extends via the opening 74 along the latch guide 20.

A cutout 76 is provided at a lower edge portion on the forward end portion of the support arm 16 to allow a fixing leg 58 of the latch guide 22 to pass therethrough and a cutout 78 is provided at an upper edge portion at the forward end side of the support arm 16 so as to prevent an interference with a lug 80 of the latch arm 18. The fixing leg 58 extends outwardly via the cutout 76.

The latch arm 18 has a pair of projections 82, 82 at its forward end and has a recess 84 provided on its side facing the support arm 16 so as to receive a curved portion 55 provided on the spring section 54 of the latch guide 22. An engaging projection 86 for latching the printed board 6 (see FIGS. 3 and 4) extends upwardly from the upper surface of the latch arm 18. An internally inclined cam 88 is provided on the upper side of the engaging section 88 and a lug 80 is provided on the support arm 16 side. By operating the lug 80, the latch arm 18 can be displaced in a curved way between a position (a position as shown in FIG. 1) in which the side edges of the printed board are latched by the latching sections 86 and a position (a position as shown in FIG. 7) in which the printed board is unlatched.

The latch arms 20 for latching the side edges of the printed circuit board 8 (FIGS. 3 and 4) are situated at an upper sides of the latch arms 18 and somewhat externally. The latch arm 20 has a lug 90 extending toward the support arm 16 and an engaging projection 92 extending on a side opposite to the lug 90 and latching the side edge of the printed board 8. A cam section 94 is provided on the upper side of the engaging projection 92 and the unlatched position of the latch arm 20 is as shown in FIG. 6.

In the case where the latch guide 22 is latched at the support arm 16, the latch section 56 is aligned with the slit 70 and inserted in a gap between the support arm 16 and the latch arm 18. The spring section 54 and curved portion of the latch guide are guided in the recess 55 of the latch arm 18 and the fitting section 50 is placed in the receiving recess 68 of the support arm. In this state, the latching section 56 and fitting section 50 hold the fixing section 72 firmly in place and the fitting section 50 is abutted against the side surface of the receiving recess 68. The guide arm 62 is projected via the opening 74 out of the support arm 16 and extends along the latch arm 20. Further, the forward end 66 of the auxiliary arm 64 is abutted against the lug 90 on the engaging projection 92 side of the latch arm 20.

Figure 6:
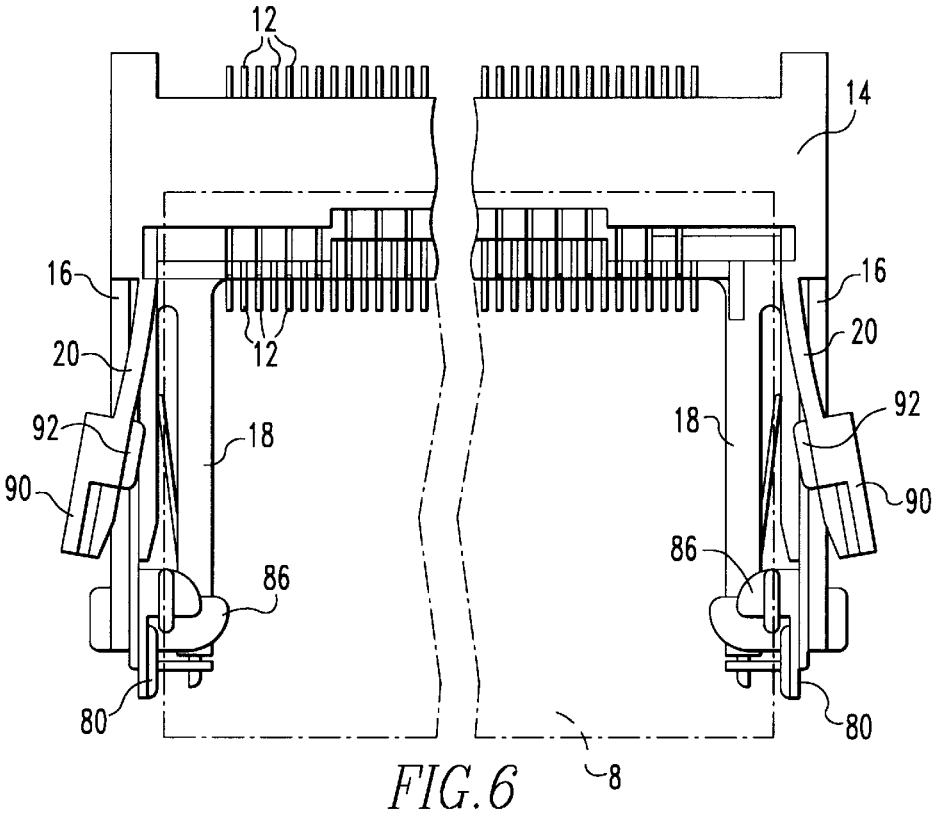
FIG. 6 is an explanatory view showing an operation of one pair of latch arms.
Figure 7:
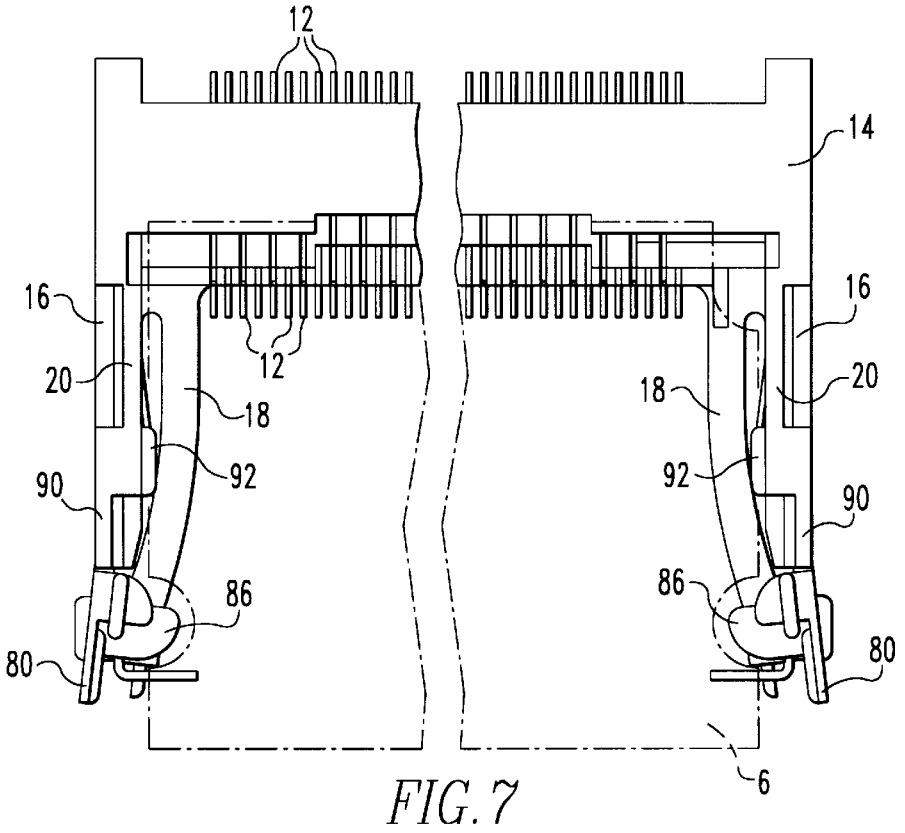
FIG. 7 is an explanatory view showing an operation of the other pair of latch arms.

FIGS. 6 and 7 show the operations of the latching mechanism so arranged. Although these Figures are separately shown so as to show the respective operations of the latch arms 18 and 20, it will be readily evident that the respective latch arms 18 and 20 are operated simultaneously.

As shown in FIG. 6, when the printed board 8 (FIG. 3) is inserted into the insertion slot 34 of the housing 14 and rotated into abutting engagement with the engaging projection 92 of the latch arm 92, then the cam surface 94 (FIG. 5) on the engaging projection 92 urges the latch arms 20 outwardly. At this time, the guide arms 62 of the latch guides 22 are, together with the latch arms 20, deformed, while preventing twisting of the latch arm 20, and so guided as to allow the latch guide 20 to be displaced in an arcuate way.

When, with the printed board 8 further rotated, the printed board 8 is moved clear of the engaging projection 92, the latch arms 20, 20 are returned to a latched position under their own elastic force and a spring force of the guide arm 62. By doing so, the side edges of the printed board 8 are latched by the engaging projection 92 and held in the rotated position. At this time, since the urging forces of the spring contacts 12C, 12D are transmitted by the printed board 8 and engaging projections 92 to the latch arms 20, 20, a twisting force acts upon the latch arms 20, 20 along their axes. Since, however, the auxiliary arms 64 of the latch arms 22 are abutted against the lugs 90, the latch arms 20, 20 hold the printed board 8 in place without being twisted. To this end, the forward end of the auxiliary arms 64 are preferably abutted against the lower side of the lugs 90.

An explanation will be given below about the operation of the latch arms 18 with reference to FIGS. 1, 5 and 7.

When the printed board 6 is inserted in the insertion slot 32 of the housing 14 and rotated into abutting engagement with the engaging projections 86 of the latch arms 18, the cams 88 on the engaging projections 86 urge the latch arms 18 outwardly. The latch arms 18 starts immediately moving from the latched position as shown in FIG. 1, causing the side edges of the printed board 6 to move outwardly toward the direction of the support arms 16 while sliding on the cam faces 88.

With the printed board 6 further rotated, the latch arms 18 are moved toward the direction of the support arms 16 while depressing the spring sections 54. By doing so, the latches 18, 18 are opened and the printed board 6 is further rotated clear of the cam faces 88 and the printed board 6 is abutted against the upper surfaces of the latch arms 18, 18 to prevent its excessive movement. As a result, the latch arms 18 are returned back to the latched position under their own elastic force and a spring force of the latch guide 22. By doing so the side edges of the printed board 6 are latched by the engaging projections 86, thus being held in the rotated position.

According to the present invention, since the spring section 54 is provided on the latch guides 22, the latch arms 18 can be returned immediately even if the printed board 8 is abutted against the upper surfaces of the latch arms 18.

In the case where the printed circuits 6 and 8 are to be removed, the latch arms 18, 20 are turned externally by the lugs 80, 90 to the unlatched positions as shown in FIGS. 6 and 7. By doing so, the printed boards 6, 8 are unlatched from the engaging projections 86, 92. The printed boards 6, 8 are turned away from the latch arms 18, 20 by the urging forces of the spring contacts 12.

In moving the latch arms 18 between the latching position and the unlatching position the respective projections 82 are slidably guided on the guide edges provided at the edges of the guide sections 52 to allow the engaging projections 86 to be moved along the flat plane of the printed board 6. By doing so, the engaging projections 86 made of an insulating material allow a smooth engagement with the side edges of the printed board 6. Further, bending- and twisting-direction forces acting from-the printed board 6 through the engaging projections 86 to the latch arms 18 are transmitted to the support arms 16 through the guide sections 52 and fitting sections 50 and also to the mother board 4 through the fixing legs 58 of the latch guides 58. For this reason, the printed board 6 is held very firmly in place while maintaining the easiness with which the latch arms 18 are curved. Further, since the latch guide 22 made of a metal is held between the support arm 16 and the latch arm 18, the safety of the daughter board is secured due to the metal portion of the latch guide being hardly exposed to an outside.

Figure 8:
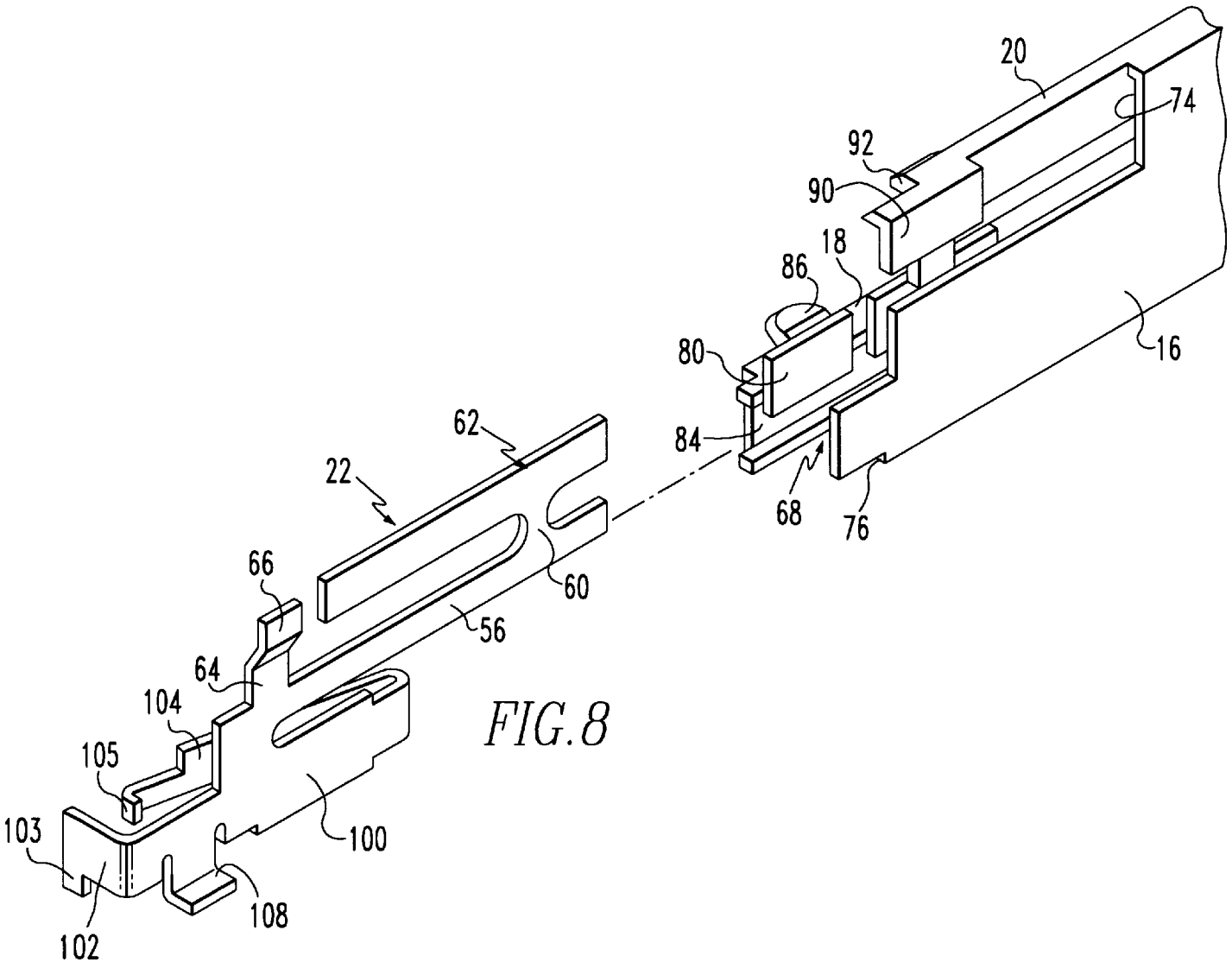
FIG. 8 is a perspective view diagrammatically showing a latch mechanism according to a variant of the present invention.
Figure 9:
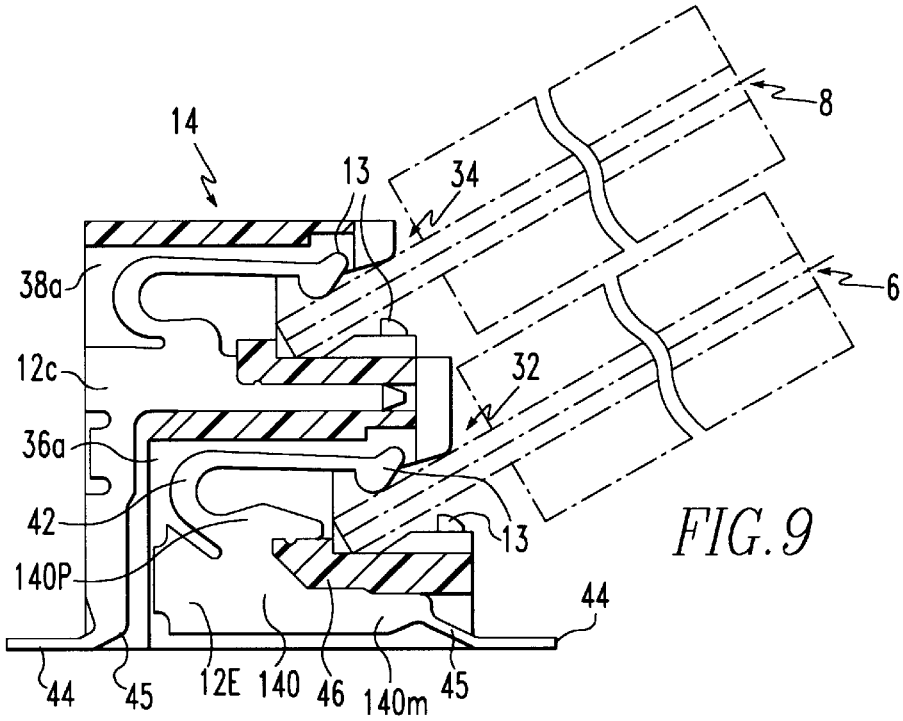
FIG. 9 is a cross-sectional view, similar to that of FIG. 3, showing spring contacts according to a variant of the present invention.
Figure 10:
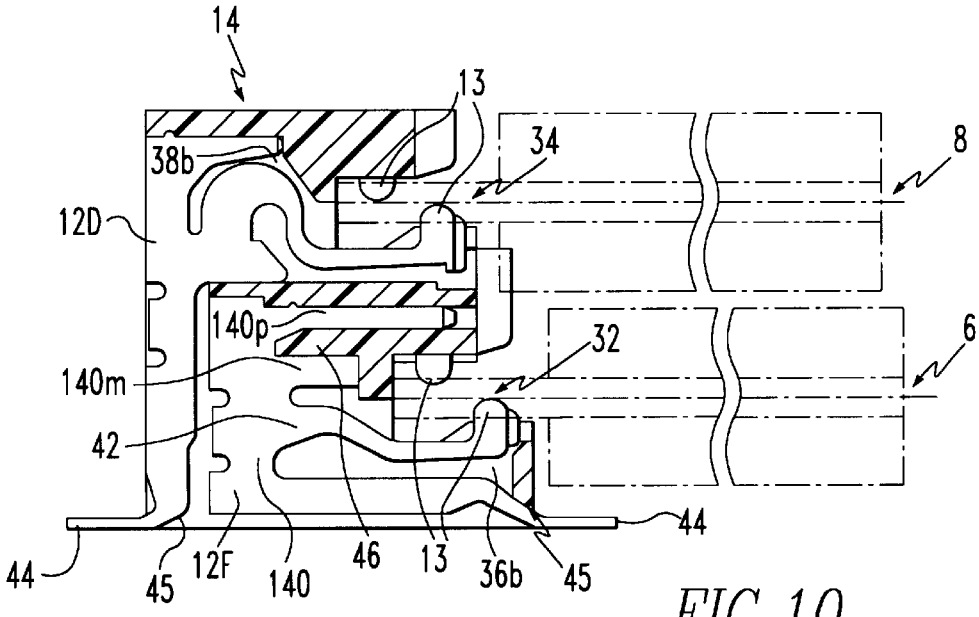
FIG. 10 is a cross-sectional view, similar to that of FIG. 4, showing spring contacts according to a variant of the present invention.

FIGS. 8 to 10 show a variant of a socket 10 for printed boards. In FIGS. 8 to 10, the same reference numerals are employed to designate parts and elements corresponding to those shown in the embodiment above.

The socket of this variant enables the lowering of a height to which it extends from the mother board.

A latch mechanism of the variant is made lower in the height of a fitting section 100, guide section 102 and spring section 104 of a latch guide 22 with only one projection 103 provided on the forward end portion of the guide section 102. Further, a curved portion 105 merging with a spring section 104 of the latch guide is made lower in height than the spring section 104. In addition to a receiving recess 68 of a support arm 16 where the guide section 102 is fitted, a recess 84 of a latch arm 18 is also made lower in the height dimension. For this reason, it is possible to reduce the height of the support arm 16, latch arm 18 and housing 14.

FIGS. 9 and 10 show a variant of spring contacts 12 held in the housing 14 of such a lower height.

Those spring contacts 12C and 12D are the same as those of the above-mentioned embodiment in that those downwardly extending legs are lower than the counterparts of the embodiment. On the other hand, spring contacts 12E and 12F providing a spring contact array at an insertion slot 32 have their fixing sections 140 different from those of the spring contacts 12A and 12B shown in FIGS. 3 and 4.

As shown in FIG. 9, the fixing section 140 of the spring contact 12E firmly grasps a fixing wall 46 between a post section 140P and an arm section 140M and a flexible area 45 is formed on a leg section extending from the arm section 140M and an electroconductive section 44 is formed on the forward end portion of the flexible section 45. As shown in FIG. 10, the fixing section 140 of the spring contact 12F firmly grasps the fixing wall 46 between the arm section 140M and post section 140P arranged above a spring section 42. The leg section of the spring contact extends from the lower end side of the fixing section 140 toward that forward end side where the insertion slot 32 is opened, the forward end portion of the fixing section having a flexible area 45 and electroconductive section 44. An adequate gap is provided between the leg section and the spring section 42, thus offering no bar to the function of the spring 42.

Contact grooves 36*a* and 36*b* holding the spring contacts 12E and 12F in place are opened on a side opposite to the insertion slot 32 and a connection area for leading the electroconductive area 44 to an outside of the housing 14 is opened on the same side as that of the insertion slot 32. Therefore, the insertion holes of the contact grooves 36A and 36B are opened on the same side as contact grooves 38*a*, 38*b* holding the spring contacts 12C and 12D in place. The connection areas of the contact grooves 36A, 36B are opened on the side opposite to the connection areas of the contact grooves 38A, 38B. The fixing wall 46 is projected from the insertion slot 32 opening side toward the left or rear side in FIG. 10 and into a holding area. When, therefore, the spring contacts 12E and 12F are inserted into the insertion holes provided on the left side, the insertion wall 46 are allowed to be fitted between the post section 140P and the arm section 140M. By doing so, the fixing wall 46 is firmly grasped between the post section 140P and the arm section 140M so that the spring contacts 12E and 12F are positively fitted in the contact grooves 36A,36B.

In consequence, the socket shown in FIGS. 9 and 10 allows the respective spring arms 12C, 12D, 12E and 12F to be very easily fitted therein without interference with the support arm 16 and latch arms 18, 20 and, at the same time, the socket allows mutually adjacent electroconductive sections of these spring arms to be maintained at requisite intervals.

As set out above, according to the socket of the present invention, a housing of an insulating material has a plurality of insertion holes opened on one side to allow the edges of printed boards to be received therein, a greater number of spring contacts of an electroconductive material are formed in at least one contact array, have their contact sections projected into, and along a longitudinal direction of, the insertion holes and urge the printed boards in the same direction with their edges inserted relative to the respective contact array into the insertion holes, and a plurality of pairs of latch arms extend from near-end areas of the respective insertion holes and, when the respective printed boards are rotated in a direction to urge the contacts, latch the side edges of the printed boards in place whereby the printed boards fitted at the respective insertion holes are held in place by the paired latch arms in a juxtaposed relation. It is, therefore, possible to latch and unlatch the printed boards readily and positively and to manufacture sockets at low costs in a very simple way.

Figure 11:
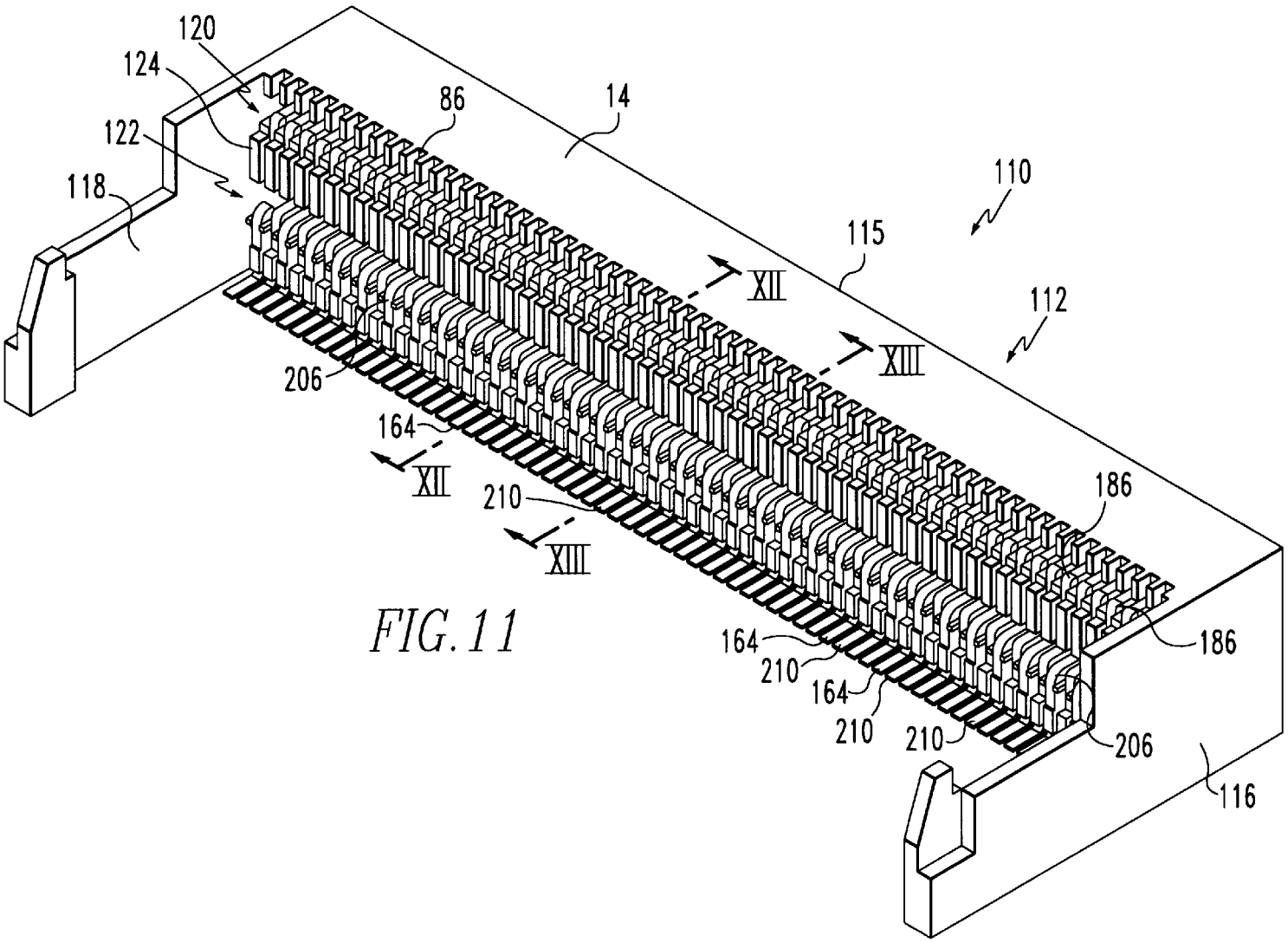
FIG. 11 is perspective view of a DDIM which is a second preferred embodiment of the present invention.

Referring now to FIG. 11 there is shown a double-deck in-line module (DDIM) or dual in-line module (DIM) generally designated 110 (the module) such as are utilized for connecting memory cards or the like. The module 110 is designed to horizontally receive such cards. In keeping with the above, it should be understood that the applicability of the present invention is not limited to DDIM's or DIM's, but to all electrical connectors that are essentially "mounted" to a circuit board by their solder tails regardless of whether insertion of a card into the module is horizontal or vertical.

The module 110 is characterized by a plastic housing 112 defined by a longitudinal wall 1 12 having a longitudinal top portion 114 and a longitudinal rear portion 115. Integral with the longitudinal wall 112 is a right side wall 116 and a left side wall 118 that assist in guiding the cards into the module 110. It should be noted that while the housing 112 is preferably made of plastic, other suitable non-conductive materials may also be utilized. The housing 112 defines a top longitudinal row or channel 120 and a bottom longitudinal row or channel 122 that are separated by a middle partition 124.

Figure 12:
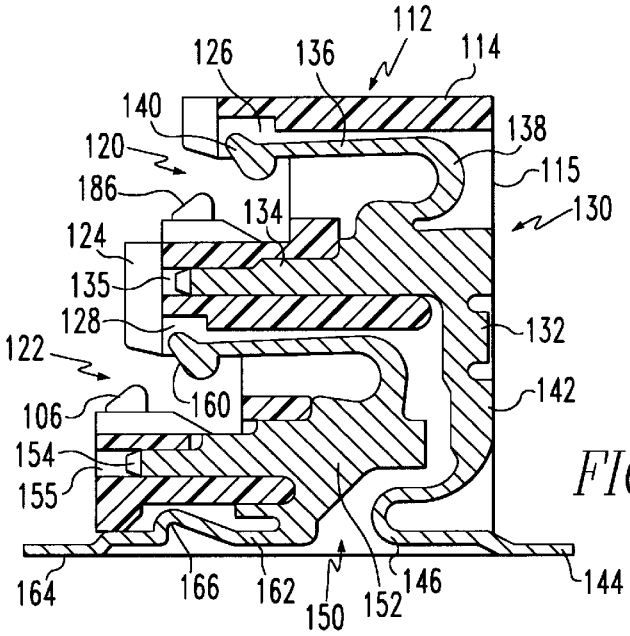
FIG. 12 is an enlarged sectional view of the DDIM taken along line 12—12 of FIG. 11 showing the upper contacts of the top and bottom longitudinal card or PCB receiving slots.

Referring in addition to FIG. 12, the housing 112 is shown in cross section. The top longitudinal channel 120 is adapted to receive the edge of a memory card or the like that generally carries memory chips (not shown) while the bottom longitudinal channel 122 is likewise adapted to receive the edge of a second memory card of the like (not shown). While not shown, the typical memory card is a printed circuit board (PCB) that carries various memory chips and related electrical components. The chips and components are coupled to leads that terminate in thin electrically conducting strips proximate one edge of the PCB of the memory card. On one side of the PCB the leads are laterally spaced apart from one another by an open strip of PCB. On the opposite side of the PCB, the leads are also laterally spaced apart from one another by an open strip of PCB. However, the leads on one side of the PCB are opposite the open strips of the other side of the PCB, with the leads on the other side of the PCB opposite the open strips of the one side of the PCB. In this manner, the leads of both sides are staggered along the edge of the PCB.

Figure 15:
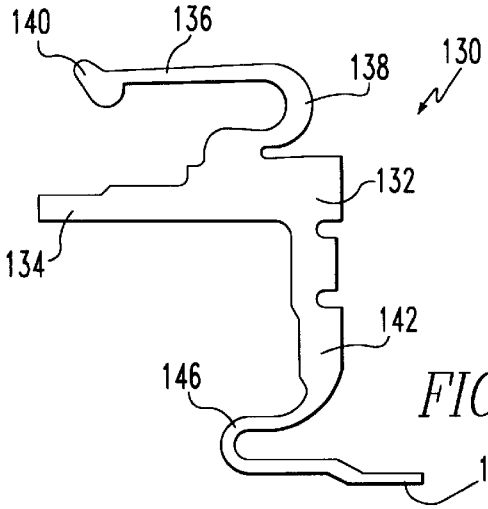
FIG. 15 is a side view of the upper contact for the top slot.

The top longitudinal channel 120 defines an upper surface area 126 for each of the plurality of upper contacts 130. Embedded in or molded into the housing 112 is a plurality of upper contacts of which in FIG. 12 only one such upper contact 130 is shown. Each upper contact 130 is adapted to provide electrical contact with respective upper leads (not shown) of the top memory card in the manner detailed below. Because each upper contact 130 is the same, only one such contact 130 will herein be described. The upper contact 130 is specifically shown in FIG. 15 and is characterized by a body 132, an integral anchoring or stabilizing leg 134, an integral terminal 136, and an integral solder tail 142. The entire upper contact 130 is blanked or stamped from a suitable conducting metal, coated or uncoated, to provide rigid edges and co-planarity of the solder tails.

The anchoring leg 134 is retained in a channel 135 within the housing 112 while the terminal 136 resiliently projects from the body 132 through a bend or spring portion 138 and terminates in a contact tip 140. The terminal 136 is positioned adjacent the upper surface 126 of the top longitudinal channel 120 with the contact tip 140 downwardly projecting therefrom. Because the terminal 136 is resiliently attached to the body 132, the protruding tip 40 is biased to make contact with the leads of the one side of the PCB (not shown) as the PCB is inserted into the top longitudinal channel 120. As best seen in FIG. 12, the solder tail 142 terminates exterior to the housing 112 in a solder point 144. The solder point 144 is that portion of the solder tail 142 that is soldered to a solder pad (not shown) that is disposed on the main PCB (not shown).

In accordance with the present invention, located between the body 132 and the solder point 144 of the contact 130 is a compliant section 146. The compliant section 146 absorbs and/or isolates stresses induced in the solder tail 142 that would ordinarily be transmitted to the solder point 144 and the solder pad (not shown). The compliant section 146 increases the solder tail flexibility or reduces the solder tail 146 stiffness as the stress point is moved away or out from the solder point 144 to the solder pad (not shown) junction. In the embodiment shown, the compliant section 146 is a sideways oriented U-shaped bend, but can be any type of spring shape or the like that accomplishes absorption and/or isolation of the forces or stresses induced in the housing during card insertion or through PCB warpage.

Figure 14:
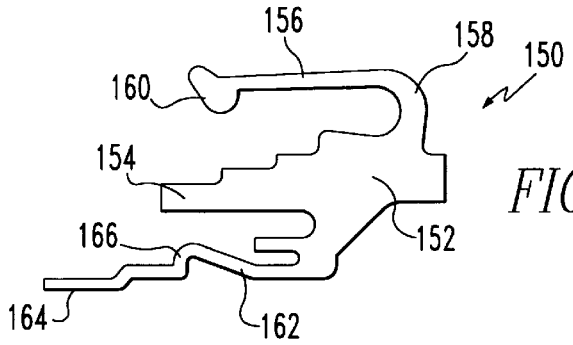
FIG. 14 is a side view of the upper contact for the bottom slot.

With reference again to FIG. 12, the bottom longitudinal channel 122 defines an upper surface area 128 for each of the plurality of upper contacts 150. In like manner to the upper contacts 130 of the top longitudinal channel 120, embedded in or molded into the housing 112 a plurality of upper contacts of which in FIG. 12 only one such upper contact 150 is shown of the bottom longitudinal channel 122. Each upper contact 150 is adapted to provide electrical contact with the respective upper leads (not shown) of a bottom memory card (not shown). Because each upper contact 150 is the same, only one such upper contact 150 will herein be described. The upper contact 150 is specifically shown in FIG. 14 and is characterized by a body 152, an integral anchoring or stabilizing leg 134, an integral terminal 156, and an integral solder tail 162. In like manner to the upper contact 130 of the top longitudinal channel 120, the upper contact 150 is blanked or stamped from a suitable conducting metal, coated or uncoated, to provide rigid edges and co-planarity of its solder tail.

The anchoring leg 154 is retained in a channel 155 within the housing 112 while the terminal 156 resiliently projects from the body 152 through a bend or spring portion 158 and terminates in a contact tip 160. The terminal 156 is positioned adjacent the upper surface 128 of the bottom longitudinal channel 122 with the contact tip 160 downwardly projecting therefrom. Because the terminal 156 is resiliently attached to the body 152, the protruding tip 160 is biased to make contact with the leads of the one side of the PCB (not shown) as the PCB is inserted into the bottom longitudinal channel 122. As best seen in FIG. 12, the solder tail 162 terminates exterior to the housing 12 in a solder point 64. The solder point 164 is that portion of the solder tail 162 that is soldered to a solder pad (not shown) that is disposed on the main PCB (not shown).

In accordance with the present invention, located between the body 152 and the solder point 164 of the contact 150 is a compliant section 166. The compliant section 166 absorbs and/or isolates stresses induced in the solder tail 162 that would ordinarily be transmitted to the solder point164 and the solder pad (not shown). The compliant section 166 increases the solder tail flexibility or reduces the solder tail stiffness as the stress point is moved away or out from the solder point 164/solder pad junction (not shown). In the embodiment shown, the compliant section 66 is an upwards oriented essentially U-shaped bend, but can be any type of spring shape or the like that accomplishes absorption and/or isolation of the forces or stresses induced in the housing during card insertion or through PCB warpage.

Figure 13:
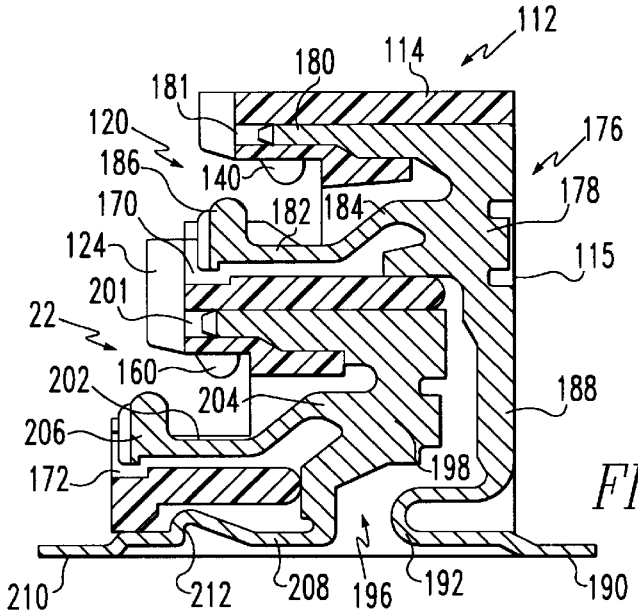
FIG. 13 is an enlarged sectional view of the DDIM taken along line 13—13 of FIG. 1 showing the lower contacts of the top and bottom longitudinal card or PCB receiving slots.

Both of the upper contacts 130 and 150 of the respective top and bottom longitudinal channels 120 and 122 are essentially flat conductors that lie in a common axial plane to form top and bottom pairs of upper contacts or terminals. As best seen in FIG. 11, there are a plurality of such top and bottom pairs of upper contacts disposed along the longitudinal length of the housing 112. Disposed between each upper contact pair 130, 150 in an alternating or staggered fashion are pairs of lower contacts 178 and 198 as best seen in FIG. 13. Both of the lower contacts 178 and 198 of the respective top and bottom longitudinal channels 120 and 122 are essentially flat conductors that lie in a common axial plane to form top and bottom pairs of lower contacts or terminals. Again, as best depicted in FIG. 11, there are a plurality of such top and bottom pairs of lower contacts disposed along the longitudinal length of the housing 112.

Figure 17:
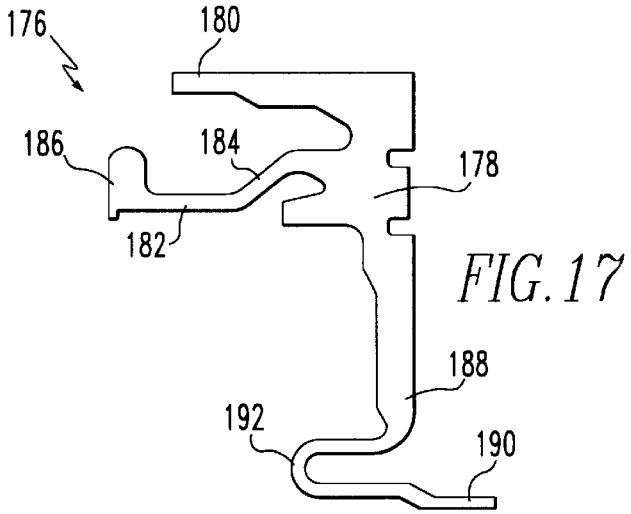
FIG. 17 is a side view of the lower contact for the top slot.

With specific reference to FIG. 1, the top longitudinal channel 120 has a lower surface area 170 for each of the plurality of lower contacts 176. Again, in like manner to the upper contacts 130 and 150, the lower contacts 176 are embedded in or molded into the housing 112 and are adapted to provide electrical contact with the lower respective leads (not shown) of a top memory card (not shown). Because each lower contact 176 is the same, only one such lower contact 176 will herein be described. The lower contact 176 is specifically shown in FIG. 17 and is characterized by a body 178, an integral anchoring or stabilizing leg 180, an integral terminal 182, and an integral solder tail 188. Again, in like manner to the upper contacts 130,150, the lower contact 176 is blanked or stamped from a suitable conducting metal, coated or uncoated, to provide rigid edges.

The anchoring leg 180 is retained in a channel 181 within the housing 112 while the terminal 182 resiliently projects from the body 178 through a bend or spring portion 184 and terminates in an upwardly biased contact tip 186. The terminal 176 is positioned adjacent the lower surface 170 of the top longitudinal channel 120 with the contact tip 186 upwardly projecting therefrom. Because the terminal 182 is resiliently attached to the body 178, the protruding tip 186 is biased to make contact with the leads of the lower side of the PCB (not shown) as the PCB is inserted into the top longitudinal channel 120. As best seen in FIG. 13, the solder tail 88 terminates exterior to the housing 112 in a solder point 190.

Again, in accordance with the present invention, located between the body 178 and the solder point 190 of the contact 176 is a compliant section 192. The compliant section 192 absorbs and/or isolates stresses induced in the solder tail 188 that would ordinarily be transmitted to the solder point 190 and the solder pad (not shown). The compliant section 192 increases the solder tail flexibility or reduces the solder tail stiffness as the stress point is moved away or out from the solder point 190/solder pad junction (not shown). In the embodiment shown, the compliant section 192 is a sideways oriented U-shaped bend, but can be any type of spring shape or the like that accomplishes absorption and/or isolation of the forces or stresses induced in the housing during card insertion, PCB warpage or the like.

Figure 16:
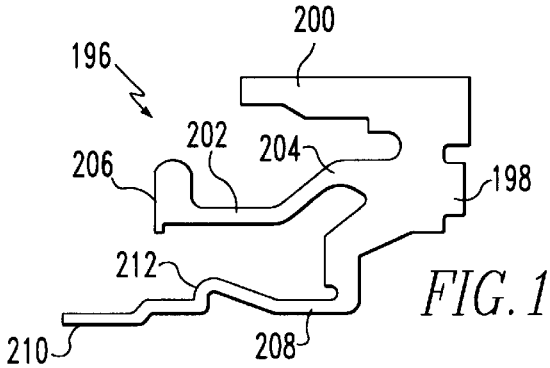
FIG. 16 is a side view of the lower contact for the bottom slot.

Again, with specific reference to FIG. 13, the bottom longitudinal channel 122 has a lower surface area 172 for each of the plurality of lower contacts 196. In like manner to the contacts 130,150, and 176, each lower contact 196 is embedded in or molded into the housing 112 and is adapted to provide electrical contact with the lower leads (not shown) of a bottom memory card (not shown). Because each lower contact 196 is the same, only one such lower contact 196 will herein be described. The lower contact 196 is specifically shown in FIG. 16 and is characterized by a body 198, an integral anchoring or stabilizing leg 200, an integral terminal 202, and an integral solder tail 208. Again, in like manner to the other contacts 130, 150, and 176, the lower contact 196 is blanked or stamped from a suitable conducting metal, coated or uncoated, to provide rigid edges.

The anchoring leg 200 is retained in a channel 201 within the housing 112 while the terminal 202 resiliently projects from the body 198 through a bend or spring portion 204 and terminates in a contact tip 206. The terminal 196 is positioned adjacent the lower surface 172 of the bottom longitudinal channel 122 with the contact tip 206 upwardly projecting therefrom. Because the terminal 202 is resiliently attached to the body 198, the protruding tip 106 is biased to make contact with the leads of the lower side of the PCB (not shown) as the PCB is inserted into the bottom longitudinal channel 122. As best seen in FIG. 13, the solder tail 208 terminates exterior to the housing 112 in a solder point 210.

Again, in accordance with the present invention, located between the body 198 and the solder point 210 of the contact 196 is a compliant section 202. The compliant section 202 absorbs and/or isolates stresses induced in the solder tail 108 that would ordinarily be transmitted to the solder point 210 and the solder pad (not shown). The compliant section 212 increases the solder tail flexibility or reduces the solder tail stiffness as the stress point is moved away or out from the solder point 210/solder pad junction (not shown). In the embodiment shown, the compliant section 212 is an upwards oriented U-shaped bend, but can be any type of spring shape or the like that accomplishes absorption and/or isolation of the forces or stresses induced in the housing during card insertion, PCB warpage or the like.

With the type of module 110 as depicted in the figures, the solder points of each contact is soldered to a solder pad in order to mount the module 110 and to make electrical contact with the various circuits on the main PCB. The memory cards are inserted and removed horizontally into the module 110 such that horizontal stresses caused by card insertion would tend to pull upwards on the solder points if the present compliance sections were not present. However, because the solder tails have such compliance sections, the stresses caused by insertion and removal are not translated to the solder points but are absorbed or isolated from the solder points. The module 110 can thus limitedly move during insertion or removal without appreciable stress upon the solder points so as to cause them to detach from the solder pads on the main PCB.

While the module 110 is shown as a surface mount type module, all types of electrical connectors can benefit from the present invention. It should also be noted that all of the contacts 130, 150, 178, and 198 are blanked or stamped rather than formed. By blanking the contacts, co-planarity of the solder tails and solder points is increased. Co-planarity is how flat or co-planar are the solder tails and soldering portions relative to each other. The compliant sections or compliance action is a part of the blanked part by virtue of the integral bends or springs.

While a PCB or memory card is not shown in FIGS. 11–17, it will be understood that the module 110 may be fixed to a PCB in a way similar to the manner illustrated in connection with the first embodiment, particularly in FIG. 2. It will also be understood that memory cards may be connected to module 110 in a way similar to the manner illustrated with regard to the first embodiment, particularly in FIGS. 3–4.

The foregoing description of the present connector and its electrical contacts has indicated that the contacts or terminals are stamped or blanked. It should be understood that the contacts may likewise be molded or formed. The method of manufacture has no bearing on the innovation of a complaint section in the solder tail.

Likewise, there are equally effective ways to anchor or secure the contacts to or within the plastic housing other than by an anchoring leg as shown in the drawings. As is known in the art, the contacts are either molded with the housing or are inserted into the housing after fabrication. The contacts may be retained by any type of interference fit or by barbs located on the contact body or elsewhere.

While the foregoing is directed to the preferred embodiment of the present invention, other and further embodiments of the invention may be devised without departing from the basic scope thereof, and the scope thereof is determined by the claims which follow.

What is claimed is:

1. A contact for an electrical connector, the contact comprising:

a body;

an arm extending in a common plane from and resiliently coupled to said body;

a solder tail consisting essentially of a first end extending from said body and a second end terminating in a soldering portion; and a compliant section disposed between said body and said soldering portion, said complaint section adapted to absorb stresses induced in said solder tail.

2. The contact of claim 1, wherein said arm, said solder tail, and said compliant section are all in said common plane.

3. The contact of claim 1, wherein said compliant section is a radiused bend.

4. The contact of claim 1, wherein said compliant section is sinuous-shaped.

5. The contact of claim 1, wherein the contact is formed by stamping.

6. The contact of claim 1, further comprising an anchoring leg extending from said body and lying in the common plane.

7. The contact of claim 6, wherein said anchoring leg is disposed between said solder tail and said arm.

8. The contact of claim 6, wherein said arm is disposed between said solder tail and said anchoring leg.

9. In a dual in-line module having a housing with top and bottom slots, an electrical contact for the top slot comprising:

an elongated body retained in the housing;

a connection arm extending in a common plane from and resiliently coupled to said elongated body, said connection arm having a portion projecting into the top slot;

a solder tail consisting essentially of a first end extending from said elongated body and a second end terminating in a solder portion external from the housing; and a compliant section disposed between said elongated body and said solder portion, said complaint section adapted to absorb stresses induced in said solder tail.

10. The electrical contact of claim 9 wherein said connection arm, said solder tail, and said compliant section are all disposed in said common plane.

11. The electrical contact of claim 10 further comprising an anchoring leg extending from said elongated body and enveloped by said housing, said anchoring leg being in the common plane.

12. The electrical contact of claim 11, wherein said anchoring leg extends from a middle portion of said elongated body, said connection arm extends from a top portion of said elongated body, and said solder tail and compliant section extend from a lower portion of said elongated body.

13. The electrical contact of claim 9, wherein said compliant section is U-shaped.

14. The electrical contact of claim 13, wherein said U-shaped compliant section is oriented essentially parallel to said anchoring leg.

15. The electrical contact of claim 11, wherein said anchoring leg extends from a top portion of said elongated body, said connection arm extends from a middle portion of said elongated body, and said solder tail and compliant section extend from a lower portion of said elongated body.

16. The electrical contact of claim 15, wherein said compliant section is U-shaped.

17. The electrical contact of claim 16, wherein said U-shaped compliant section is oriented essentially parallel to said anchoring leg.

18. In a dual in-line module having a housing with top and bottom slots, an electrical contact for the bottom slot comprising:

a body retained in the housing;

a terminal arm resiliently coupled to and extending in a common plane from said body;

a solder tail consisting essentially of a first end extending from said body and a second end terminating in a solder portion external to the housing; and a compliant section disposed between said body and said solder portion, said complaint section adapted to absorb stresses induced in said solder tail.

19. The electrical contact of claim 18 wherein said connection arm, said solder tail, and said compliant section are all disposed in said common plane.

20. The electrical contact of claim 19 further comprising an anchoring leg extending from said body and enveloped by said housing, said anchoring leg being in the common plane.

21. The electrical contact of claim 20, wherein said anchoring leg extends from a middle portion of said body, said terminal arm extends from a top portion of said body, and said solder tail and compliant section extend from a lower portion of said body.

22. The electrical contact of claim 20, wherein said compliant section is a radiused bend extending towards said anchoring leg.

23. The electrical contact of claim 20, wherein said anchoring leg extends from a top portion of said body, said resilient arm extends from a middle portion of said body, and said solder tail and compliant section extend from a lower portion of said body.

24. The electrical contact of claim 23, wherein said compliant section is a radiused bend extending towards said terminal arm.

25. A dual in-line module comprising:

a housing having a bottom elongated slot and a top elongated slot, each said slot defining a respective upper elongated surface and a lower elongated surface, said slots being essentially parallel;

a plurality of first electrical contacts embedded in said housing, each of said first electrical contacts having a first body, a first terminal arm extending from and resiliently coupled to said first body and having at least a portion thereof protruding from said upper elongated surface of said top elongated slot into said top elongated slot, a first solder tail extending from said first body and terminating in a first soldering section external to said housing, and a first compliant portion disposed between said first body and said first soldering section, said first compliant portion adapted to absorb stresses induced in said first solder tail;

a plurality of second electrical contacts embedded in said housing, each of said second electrical contacts having a second body, a second terminal arm extending from and resiliently coupled to said second body and having at least a portion thereof protruding from said lower elongated surface of said top elongated slot into said top elongated slot, a second solder tail extending from said second body and terminating in a second soldering section external to said housing, and a second compliant portion disposed between said second body and said second soldering section, said second complaint portion adapted to absorb stress induced in said second solder tail;

a plurality of third electrical contacts embedded in said housing, each of said third electrical contacts having a third body, a third terminal arm extending from and resiliently coupled to said third body and having at least a portion thereof protruding from said upper elongated surface of said bottom elongated slot into said bottom elongated slot, a third solder tail extending from said third body and terminating in a third soldering section external to said housing, and a third compliant portion disposed between said third body and said third soldering section, said third compliant portion adapted to isolate stresses induced in said third solder tail; and a plurality of fourth electrical contacts embedded in said housing, each of said fourth electrical contacts having a fourth body, a fourth resilient terminal arm extending from said fourth body and having at least a portion thereof protruding from said lower elongated surface of said bottom elongated slot into said bottom elongated slot, a fourth solder tail extending from said fourth body and terminating in a fourth soldering section external to said housing, and a fourth compliant portion disposed between said fourth body and said fourth soldering section, said fourth complaint portion adapted to isolate stress induced in said fourth solder tail.

26. The dual in-line module of claim 25, wherein said first and second terminal arms are alternatingly arranged along the longitudinal length of said top slop; and said third and fourth terminal arms are alternatingly arranged along the longitudinal length of said bottom slot.

27. The dual in-line module of claim 26, wherein said plurality of first and third terminal arms form axially aligned pairs, and said plurality of second and fourth terminal arms form axially aligned pairs.

* * * * *